US008967407B2

(12) United States Patent
Apps

(10) Patent No.: US 8,967,407 B2
(45) Date of Patent: Mar. 3, 2015

(54) PLASTIC BEER KEG

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 605 days.

(21) Appl. No.: 12/509,819

(22) Filed: Jul. 27, 2009

(65) Prior Publication Data

US 2011/0017737 A1 Jan. 27, 2011

(51) Int. Cl.

| | |
|---|---|
| ***B65D 6/00*** | (2006.01) |
| ***B65D 8/00*** | (2006.01) |
| ***B65D 25/14*** | (2006.01) |
| ***B65D 8/02*** | (2006.01) |
| ***B65D 21/02*** | (2006.01) |
| ***B65D 43/02*** | (2006.01) |
| ***B65D 77/04*** | (2006.01) |

(52) U.S. Cl.

CPC ..... *B65D 11/06* (2013.01); *B65D 11/08* (2013.01); *B65D 21/0233* (2013.01); *B65D 43/0212* (2013.01); *B65D 77/0486* (2013.01); *B65D 2543/00027* (2013.01); *B65D 2543/00092* (2013.01); *B65D 2543/00296* (2013.01); *B65D 2543/00407* (2013.01); *B65D 2543/00509* (2013.01); *B65D 2543/00537* (2013.01); *B65D 2543/00555* (2013.01); *B65D 2543/00629* (2013.01); *B65D 2543/00685* (2013.01); *B65D 2543/0074* (2013.01); *B65D 2543/00796* (2013.01)

USPC ..... 220/4.05; 220/4.13; 220/495.03

(58) Field of Classification Search

USPC ..... 220/4.05, 4.12, 4.13, 4.16, 4.08, 4.09, 220/649, 23.91, 495.01, 495.03, 495.04, 220/495.06, 213, 615, 616, 618, 621, 622, 220/586; 222/105, 131

See application file for complete search history.

(56) References Cited

U.S. PATENT DOCUMENTS

| | | | | |
|---|---|---|---|---|
| 3,825,145 | A | 7/1974 | Reynolds | |
| 3,827,515 | A | 8/1974 | Reynolds | |
| 3,908,871 | A | 9/1975 | Gottwald | |
| 3,952,904 | A | 4/1976 | Verlinden | |
| 4,032,047 | A | 6/1977 | Wilson | |
| 4,164,309 | A * | 8/1979 | Staats | 206/425 |
| 4,482,067 | A | 11/1984 | Saito et al. | |
| 4,491,247 | A | 1/1985 | Nitchman | |
| 4,519,219 | A | 5/1985 | Prepodnik et al. | |

(Continued)

FOREIGN PATENT DOCUMENTS

| | | |
|---|---|---|
| EP | 1 270 499 | 1/2003 |
| EP | 2281753 | 2/2011 |

(Continued)

OTHER PUBLICATIONS

European Search Report for EP Application No. 10170819.6, Oct. 25, 2010.

(Continued)

*Primary Examiner* — Robert J Hicks
*Assistant Examiner* — Shawn M Braden
(74) *Attorney, Agent, or Firm* — Carlson, Gaskey & Olds

(57) ABSTRACT

A plastic beer keg includes an outer container and an inner liner. A removable lid is secured over an opening to the container to enclose the liner. The liner includes a neck portion and a body portion. A head contact member transfers axial forces imparted by handling equipment away from the neck portion.

19 Claims, 15 Drawing Sheets

(56) References Cited

U.S. PATENT DOCUMENTS

| | | | | |
|---|---|---|---|---|
| 4,531,656 | A | 7/1985 | Nitchman | |
| 4,867,348 | A | 9/1989 | Dorfman | |
| 5,044,514 | A * | 9/1991 | Portat et al. | 220/23.87 |
| 5,046,634 | A * | 9/1991 | McFarlin et al. | 53/457 |
| 5,129,534 | A * | 7/1992 | Dunn | 220/4.33 |
| 5,203,470 | A * | 4/1993 | Brown | 229/117.3 |
| 5,267,669 | A | 12/1993 | Dixon et al. | |
| 5,345,666 | A * | 9/1994 | Matyja | 29/451 |
| 5,597,085 | A | 1/1997 | Rauworth et al. | |
| 5,833,098 | A * | 11/1998 | Gomi | 222/400.7 |
| 5,897,016 | A | 4/1999 | Wheaton | |
| 6,260,823 | B1 | 7/2001 | Weber | |
| 6,308,858 | B1 | 10/2001 | Koefelda | |
| 6,343,916 | B1 | 2/2002 | Bougamont et al. | |
| 6,415,959 | B1 | 7/2002 | Bougamont et al. | |
| 6,626,314 | B1 | 9/2003 | McHenry et al. | |
| 6,666,358 | B1 * | 12/2003 | Field | 222/400.7 |
| 6,748,789 | B2 | 6/2004 | Turner et al. | |
| 6,751,981 | B1 | 6/2004 | Burnette | |
| 6,805,267 | B2 | 10/2004 | Bougamont | |
| 7,134,578 | B2 | 11/2006 | Bougamont | |
| 7,174,762 | B2 | 2/2007 | Turner et al. | |
| 7,337,908 | B2 * | 3/2008 | Dedmon | 206/600 |
| 7,455,082 | B2 | 11/2008 | Monzel | |
| 7,546,935 | B2 | 6/2009 | Wheaton | |
| 7,819,286 | B2 * | 10/2010 | Antheil et al. | 222/105 |
| 2004/0026461 | A1 | 2/2004 | Bougamont et al. | |
| 2006/0049213 | A1 | 3/2006 | Wheaton | |
| 2008/0251542 | A1 | 10/2008 | Rossignol | |
| 2008/0277001 | A1 | 11/2008 | Wheaton | |
| 2009/0206505 | A1 | 8/2009 | Monzel et al. | |
| 2009/0320264 | A1 * | 12/2009 | Berger et al. | 29/428 |
| 2010/0077790 | A1 | 4/2010 | Apps | |
| 2010/0264140 | A1 | 10/2010 | Apps | |
| 2011/0180535 | A1 | 7/2011 | Apps | |

FOREIGN PATENT DOCUMENTS

| | | | |
|---|---|---|---|
| FR | 2 665 688 | A1 | 2/1992 |
| GB | 2188040 | | 9/1987 |
| GB | 2209740 | | 5/1989 |
| GB | 2283967 | | 5/1995 |
| WO | 2004063087 | | 7/2004 |
| WO | 2006110948 | | 10/2006 |
| WO | 2008/013819 | | 1/2008 |
| WO | WO 2008013819 | A2 * | 1/2008 |
| WO | 2008/083782 | | 7/2008 |
| WO | WO 2008087206 | A1 * | 7/2008 |

OTHER PUBLICATIONS

European Search Report for EP Application No. 09171548.2, Dec. 15, 2009.
Appeal Brief filed with the USPTO on Jul. 15, 2013 for U.S. Appl. No. 12/243,742.
Examiners Answer mailed on Oct. 28, 2013 for U.S. Appl. No. 12/243,742.
Reply Brief filed with the USPTO on Dec. 27, 2013 for U.S. Appl. No. 12/243,742.
Appeal Brief filed with the USPTO on Jun. 19, 2013 for U.S. Appl. No. 12/693,831.
Examiners Answer mailed on Oct. 24, 2013 for U.S. Appl. No. 12/693,831.
Reply Brief filed with the USPTO on Dec. 24, 2013 for U.S. Appl. No. 12/693,831.
Final Office Action mailed on Feb. 28, 2014 for U.S. Appl. No. 12/509,819.
Non-Final Office Action mailed Apr. 21, 2014 for U.S. Appl. No. 13/292,142.
Advisory Action mailed Mar. 28, 2014 for U.S. Appl. No. 13/735,323.
Response to Advisory Action filed with the USPTO on Apr. 16, 2014 for U.S. Appl. No. 13/735,323.
Response to Final Office Action filed with the USPTO on Feb. 13, 2014 for U.S. Appl. No. 13/735,323.
Advisory Action mailed Jun. 13, 2014 for U.S. Appl. No. 13/292,141.
Amendment with RCE filed with the USPTO on Jul. 24, 2014 for U.S. Appl. No. 13/292,141.
Response to Final Office Action filed with the USPTO on May 27, 2014 for U.S. Appl. No. 13/292,141.
Final Office Action mailed Mar. 24, 2014 for U.S. Appl. No. 13/292,141.
Response to Final Rejection with an RCE filed with the USPTO on Mar. 25, 2014 for U.S. Appl No. 13/292,142.

* cited by examiner

PLASTIC BEER KEG

BACKGROUND OF THE INVENTION

The present invention relates to a plastic container for liquids, particularly beverages such as beer.

Most current beer kegs include a steel body with a valve in the top for both filling the keg and for accessing the contents. The steel kegs are reusable. Empty kegs are returned and then washed and refilled in an automated process. The steel kegs are inverted, such that the valve is at the bottom of the keg to facilitate draining during cleaning. The interior of the body of the keg is washed by spraying cleansing liquids through the valve. The cleansing liquids wash the inner surface of the body of the keg and then drain downward through the valve. The kegs are typically then filled in the inverted position through the valve at the bottom of the keg. Throughout the automated process, a cylinder clamps the body of the keg with a high force (between 200 and 300 lb.) to hold the keg in place while the washing and filling heads connect to the valve at the bottom of the keg.

There are several problems with the use of steel kegs. First, they are fairly heavy, even when empty. Second, they are expensive and are not always returned by the user. If a deposit is charged to the user to ensure the return of the keg, this may discourage the user from choosing to purchase beer by the keg in the first place. However, if the deposit is too low, it is possible that the value of the steel in the keg exceeds the amount of the deposit, thus contributing to some kegs not being returned.

SUMMARY OF THE INVENTION

The present invention provides several plastic kegs with various optional desirable features.

Some of the inventive features disclosed herein permit the plastic kegs to be filled in existing automated equipment for filling steel kegs in the inverted position. The plastic beer kegs disclosed herein can be filled in the inverted position and can withstand the high clamping force typically used in this type of equipment.

In the disclosed example embodiments, a PET liner is placed within an outer, stronger, more durable plastic container. A lid is secured to the outer container and has an opening through which the valve on the PET liner extends. A head contact member adjacent a neck portion of the liner transfers axial load on the liner away from the neck portion to prevent crumpling.

In one embodiment of the present invention, the head contact member is a retainer extending down from the valve to shift the clamping load away from the neck of the liner. The retainer extends radially outward to the shoulders of the liner, nearer the cylindrical walls of the liner.

In two other embodiments of the present invention, the head contact member transfers forces to the lid of the container. The lid is secured to the neck of the liner, such that the forces on the valve are transferred to the lid, and through the lid directly to the outer container, away from the PET liner.

Several embodiments of retainers and lids are provided, as the liner, outer container and valve assembly could be the same in each of the disclosed embodiments.

These and other features of the application can be best understood from the following specification and drawings, the following of which is a brief description.

DETAILED DESCRIPTION OF THE PREFERRED EMBODIMENTS

Figure 1:
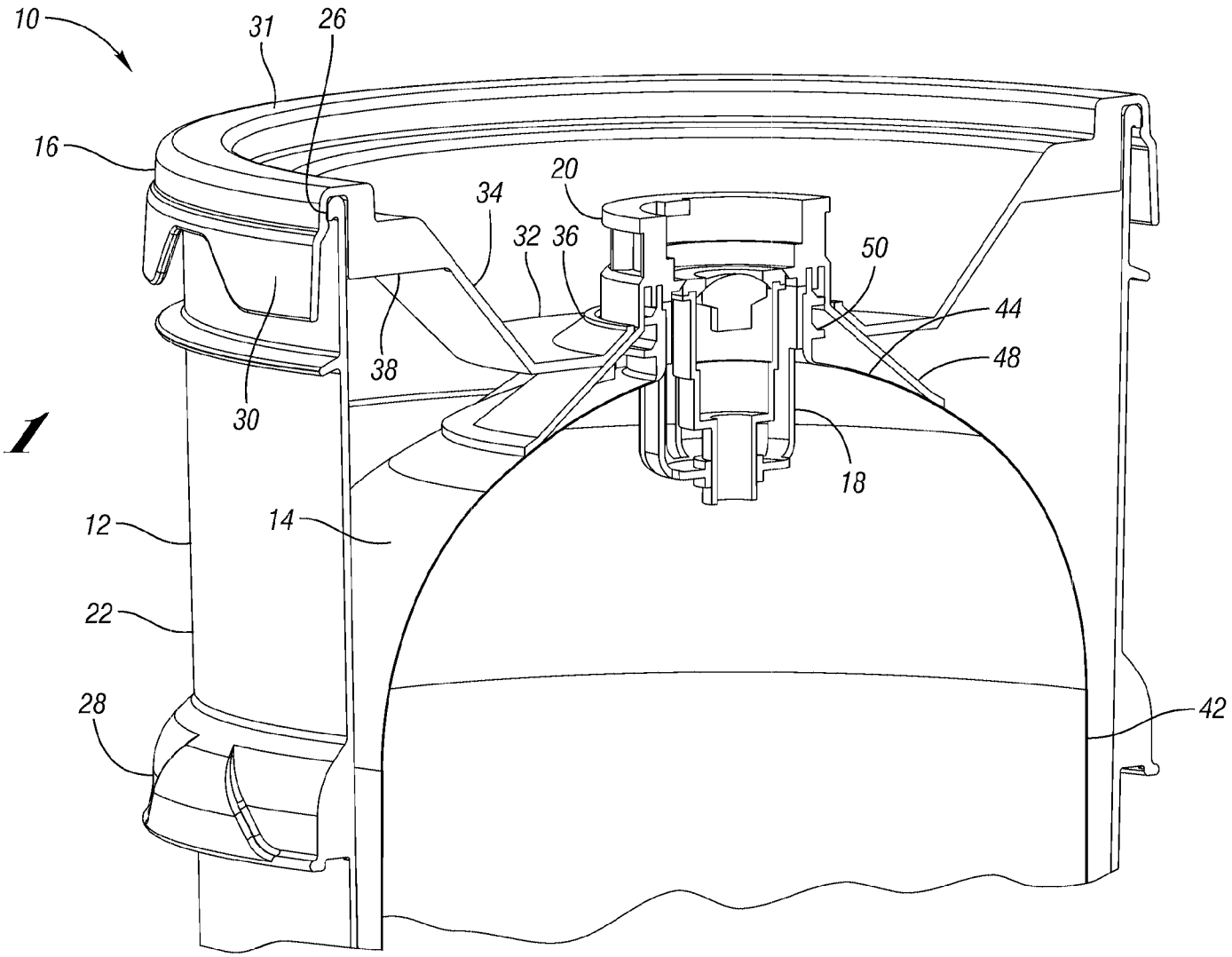
FIG. 1 is a perspective view of a plastic keg partially broken away according to a first embodiment of the present invention.

FIG. 1 shows a plastic beer keg 10 according to a first embodiment of the present invention. The plastic beer keg 10 generally includes an outer container 12 surrounding an inner liner 14, such as a PET bottle. A lid 16 is secured over an open end of the outer container 12 to retain the liner 14 within the interior of the outer container 12. A valve assembly 18 is retained in the mouth of the liner 14 by a retainer 20, which protrudes through the lid 16.

The outer container 12 includes a cylindrical outer wall 22 having an outwardly projecting lip 26 at an upper edge thereof. A skirt 28 may extend around the periphery of the wall 22 to provide ease of handling.

The lid 16 includes a lip 30 extending downward from a generally horizontal, annular rim portion 31 extending about the periphery of the lid 16 and snap-fit over the lip 26 of the outer container 12. Alternatively, the lid 16 could be threaded onto the upper end of the outer container 12. The lid 16 further includes a lower annular wall 32 spaced below the upper edge of the outer container 12 and connected by a frustoconical wall 34 to the outer periphery of the lid 16. A plurality of radially extending ribs 38 reinforce the frustoconical wall 34. An upwardly angled frustoconical wall 36 extends upwardly and inwardly from an inner periphery of the lower annular wall 32 and defines an opening through which the retainer 20 projects.

The liner 14 is a PET bottle or other suitable material having generally cylindrical side walls 42 and an upper shoulder portion 44 transitioning to a neck 50, which as shown, may be threaded. In compression vertically, the cylindrical side walls 42 are fairly strong; however, the transition between the shoulder portion 44 and the neck 50 buckles easily under a compressive load placed upon the mouth of the liner 14. These axial forces bear primarily upon the base of the container 12 on one side, with the head bearing upon the retainer 20 (the "head contact member") on the other side.

The retainer 20 is secured to the neck 50 of the liner 14 in order to retain the valve assembly 18 within the neck 50. Because the retainer 20 will also be the head contact member, the retainer also includes a skirt portion 48 extending at an angle downwardly from the neck 50 onto the shoulder portion 44 of the liner 14 near the side walls 42 of the liner 14. In this example, the diameter of the skirt portion 48 is about ⅔ the diameter of the side walls 42 of the liner 14. Thus, any weight or compressive force placed upon the retainer 20 will be distributed outward away from the neck 50 onto the shoulder portion 44 by the skirt portion 48 and distributed about a much greater surface area that is near the side walls 42 and away from the neck 50. The skirt portion 48 may contact the shoulder portion 44 of the liner with a slight interference during assembly to efficiently transfer the load from the filler head to the shoulder portion 44. The retainer 20 is secured to the neck 50 of the liner 14 by a snap-fit or by threading that locks in place when the threads bottom out.

The valve assembly 18 can be of standard design, but is preferably formed with plastic components other than perhaps the metal springs (not shown). The valve assembly 18 should also be capable of completely draining the liner 14 in the inverted position if the keg 10 is going to be used in that manner.

Figure 2:
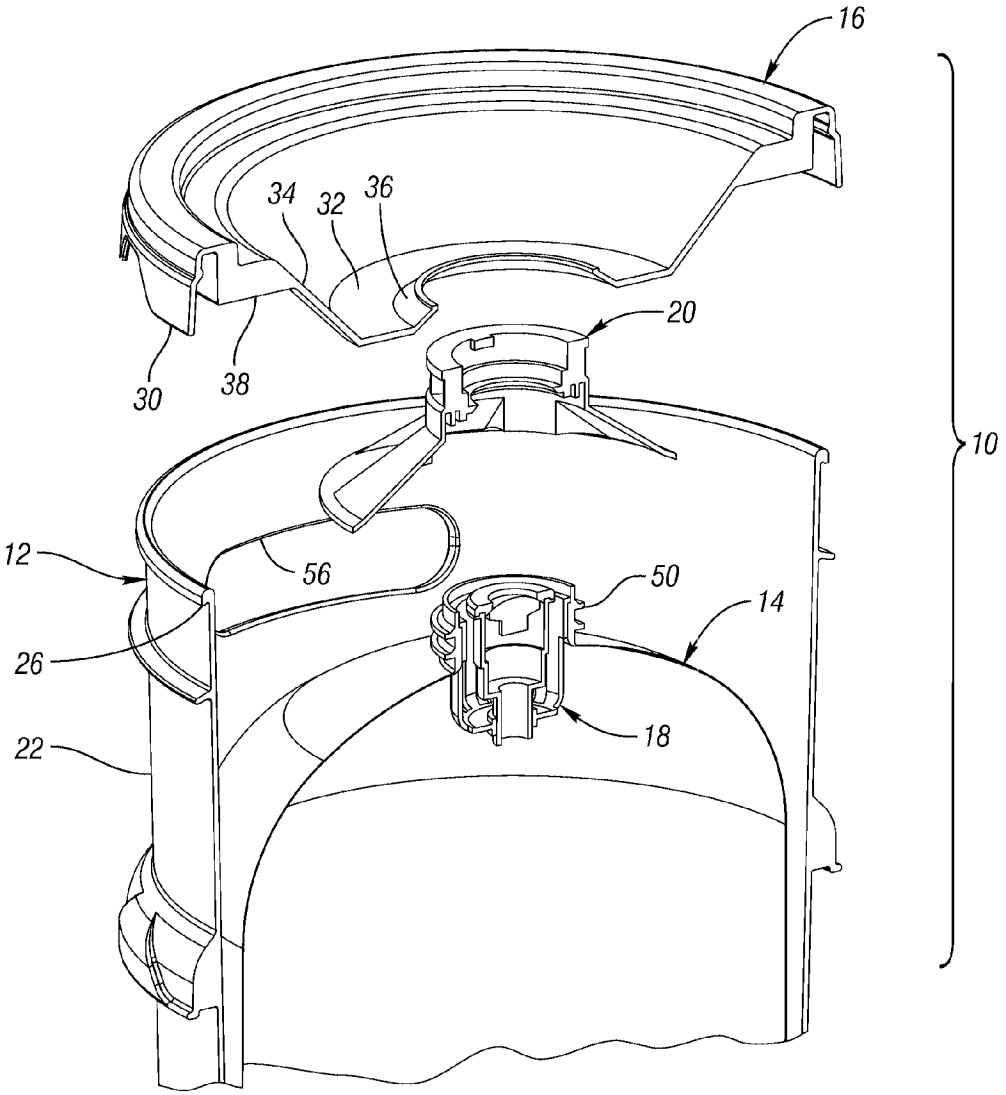
FIG. 2 is an exploded view of the keg of FIG. 1.

FIG. 2 is an exploded view of the keg 10 of FIG. 1 (with the valve assembly 18 shown installed within the neck 50 of the liner 14). As shown, the wall 22 of the outer container 12 may include handle openings 56 (one shown). The outer container 12, the lid 16, and the retainer 20 may each be separately molded of HDPE, polypropylene or other suitable materials.

Figure 3:
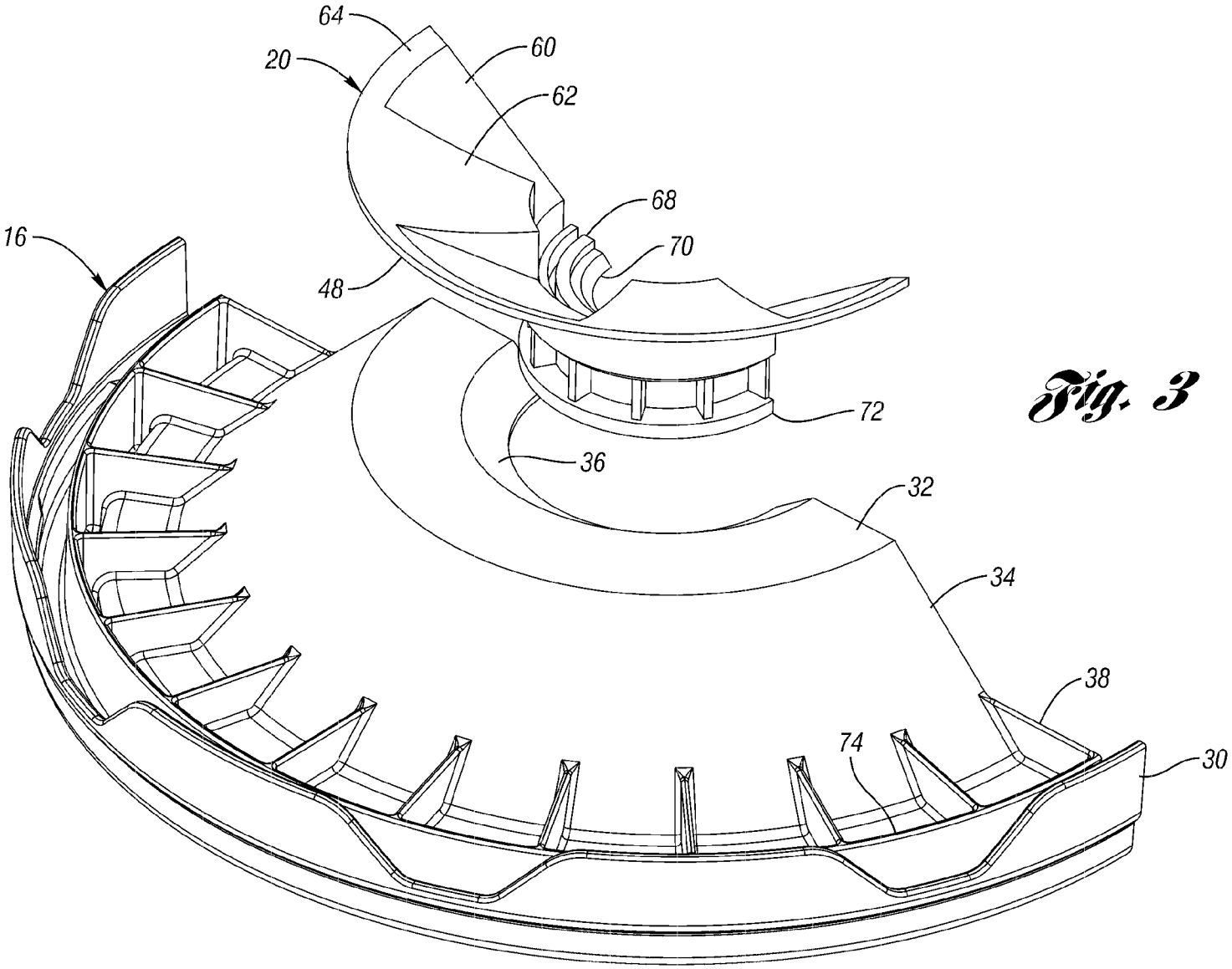
FIG. 3 is a bottom view of the exploded retainer and lid of FIG. 2.

FIG. 3 is a bottom perspective view of the partially broken away retainer 20 and lid 16 of FIG. 2. The retainer 20 includes an upper cylindrical portion 72 having a tapered inner annular portion 70 and an annular rib 68 circumscribing the tapered inner annular portion 70. The annular rib 68 and tapered inner annular portion 70 retain the valve assembly within the neck 50 of the liner 14 as shown in FIG. 1. The retainer 20 includes alternating, radially extending upper walls 60 and lower walls 62, extending to an outer annular rim 64. The upper walls 60 transfer load more directly from the upper cylindrical portion 72 to the rim 64, while the lower walls 62 provide greater surface area contact with the shoulder portion 44 (FIG. 1) of the liner 14. As can also be seen in FIG. 3, the lid 16 includes an inner annular rib 74 extending about the periphery of the lid 16 into which the ribs 38 connect. The inner annular rib 74 is spaced inwardly of the outer lip 30 of the lid 16.

Referring to FIG. 1, in use, the keg 10 can be inverted and clamped in the known automated handling equipment, which bears upon the retainer 20 (downwardly in FIG. 1, although, as indicated, in some machines, the keg 10 would be inverted). The force applied to the retainer 20 is dispersed away from the neck 50 of the liner 14 and spread over a greater area and onto a stronger shoulder portion 44 of the liner 14. The liner 14 can then be filled (and cleaned if desired) in the known handling equipment in this way. Alternatively, if necessary to further resist buckling under the compressive weight, the liner 14 can be prepressurized with a gas (e.g. air or $CO_2$). Even 10 psi prepressurization significantly increases the load capability of the liner 14. There is a gap between the walls 42 of the liner 14 and the tapered walls 22 of the outer container 12. Optionally, the liner 14, outer container 12 and lid 16 are sized such that the empty liner 14 fits loosely vertically within the outer container 12 and lid 16. Then, as the liner 14 is filled and pressurized, the height of the liner 14 increases to fit more tightly between the lid 16 and the base of the outer container 12. The liner 14, valve assembly 18 and retainer 20 can be preassembled in a clean environment and shipped as a unit for insertion into the outer container 12.

Figure 4:
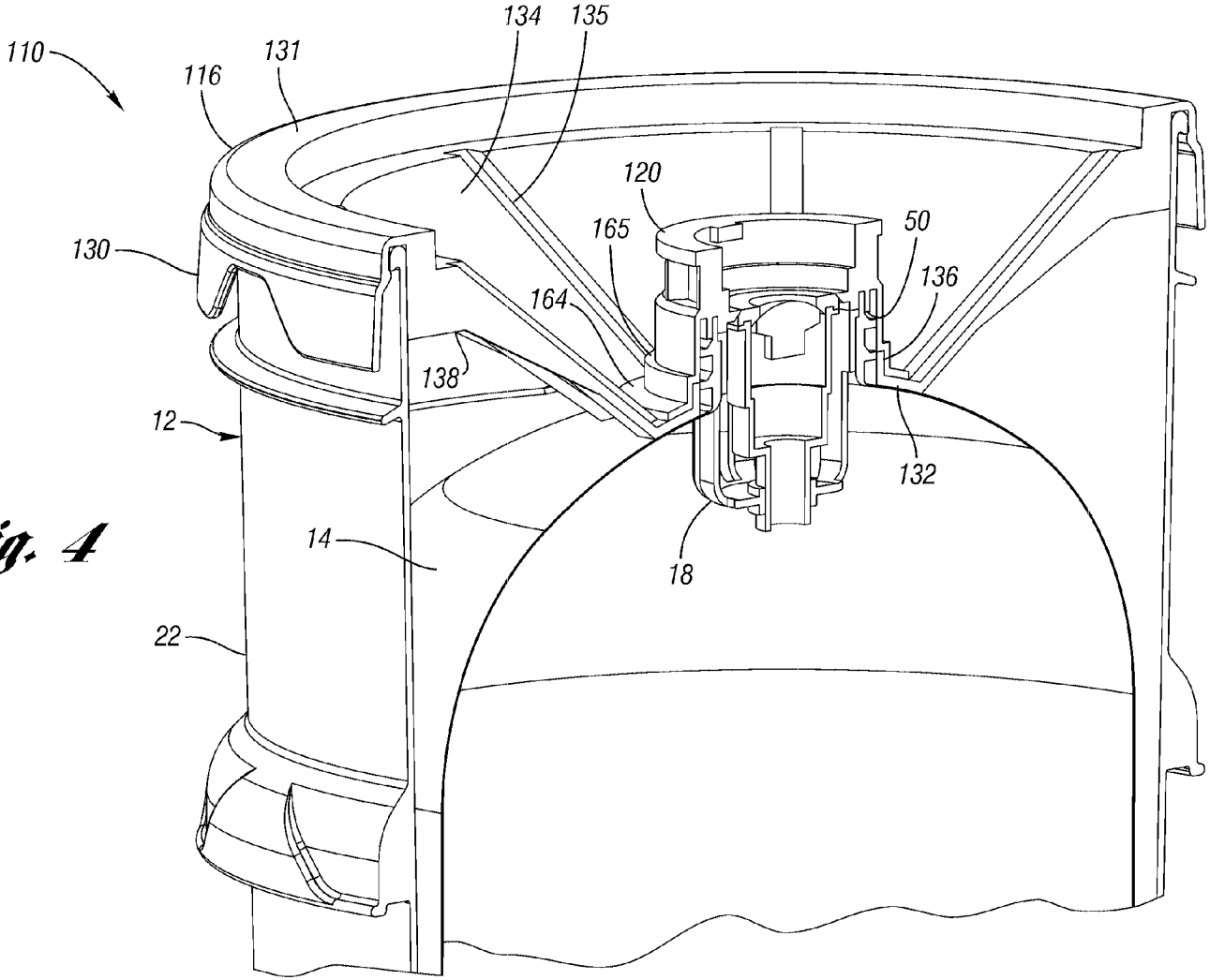
FIG. 4 is a perspective view, partially broken away, of a plastic keg according to a second embodiment of the present invention.
Figure 5:
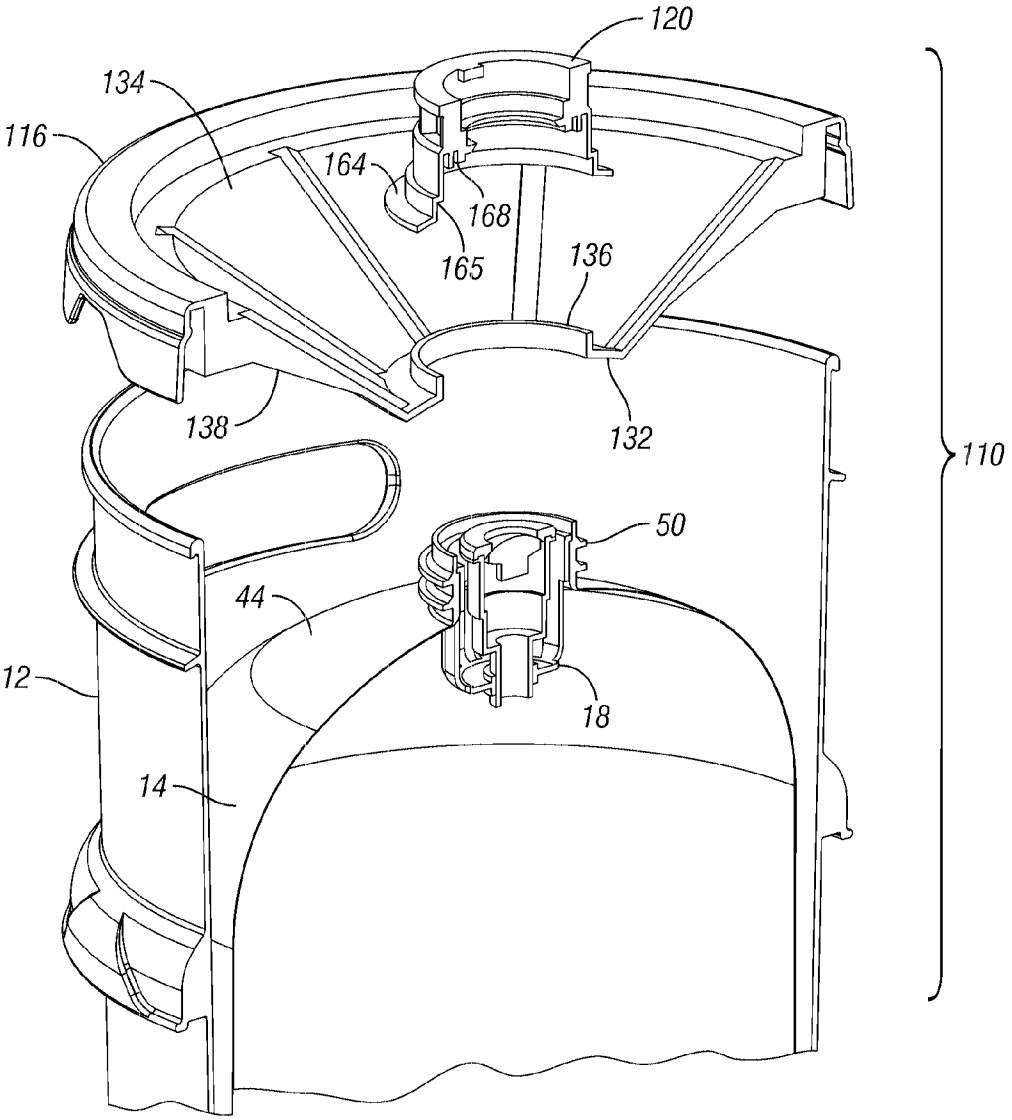
FIG. 5 is an exploded view of the keg of FIG. 4.
Figure 6:
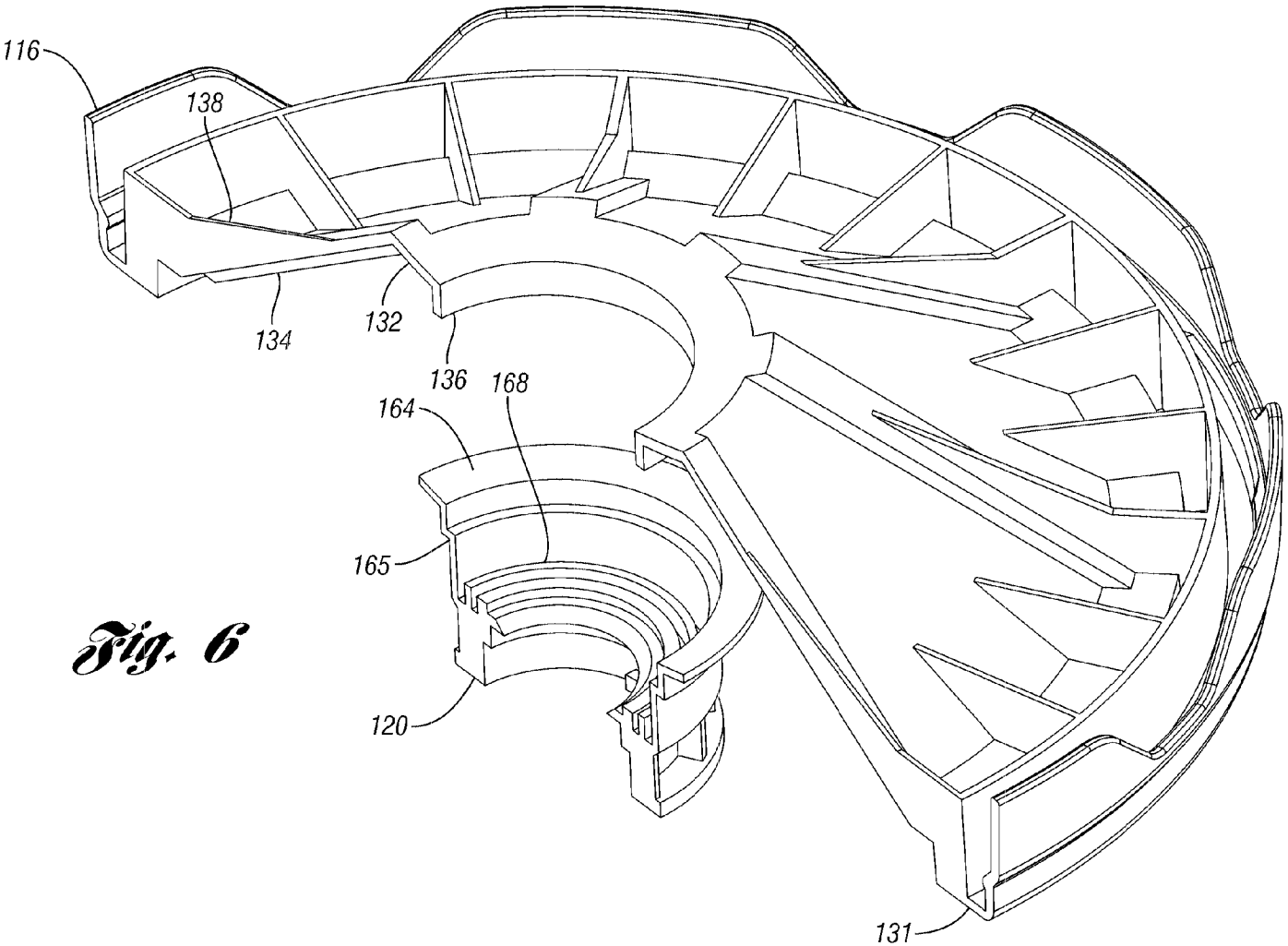
FIG. 6 is a bottom view of the keg and retainer of FIG. 5.

FIGS. 4-6 illustrate a keg 110 according to a second embodiment of the present invention, utilizing the same outer container 12 and liner 14 of FIGS. 1-3. The lid 116 includes an outer lip 130 for securing the lid 116 to the outer container 12. The lip 130 extends downward from a rim portion 131 extending about the periphery of the lid 116 on the upper periphery of the wall 22 of the outer container 12. The lid 116 further includes a lower annular wall 132 spaced downwardly from the upper most edge of the lid 116. The lower annular wall 132 may be angled upwardly towards its inner periphery and may have a somewhat spherically concave lower surface complementary to the shoulder portion 44 of the liner 14. The lower annular wall 132 is connected to the rim 130 of the lid 116 by the frustoconical portion 134. The frustoconical portion 134 of the lid 116 may be reinforced by fluted portions 135. The lid 116 further includes an inner annular vertical rib portion 136 extending upwardly from the inner periphery of the lower annular wall 132.

In this embodiment, the retainer 120 (head contact member) is secured to the neck 50 of the liner 14 (such as by threading, snap-fit or other means) but extends downward on top of the lower annular wall 132 of the lid 116. The retainer 120 includes an outer annular flange 164 bearing upon the lower annular wall portion 132 of the lid 116. The lower annular flange 164 is connected by a stepped annular portion 165 to the remainder of the retainer 120. Referring to FIG. 5, the retainer 120 further includes the annular ribs 168 for retaining the valve assembly 18 within the neck 50 of the liner 14. Referring to FIG. 6, the ribs 138 of the lid 116 may be aligned with the fluted portions 135 of the lid 116 to further reinforce the lid 116.

Referring to FIG. 4, in use, the compressive forces applied to the retainer 120 in this embodiment are transferred directly to the lower annular wall 132 of the lid 116, through the frustoconical portion 134, including fluted portions 135 and ribs 138 to the cylindrical wall 22 of the outer container 12. This transfers the forces away from the more fragile PET liner 14 to the much more durable and rigid outer container. Optionally, the PET liner 14 can be prepressurized in this embodiment too, although it should not be necessary.

The liner 14, valve assembly 18, retainer 120 and lid 116 can be preassembled in a clean environment and shipped together as a unit for installation into the outer container 12. The lid 116 and outer container 12 may optionally include a feature for preventing relative rotation while the valve assembly 18 is being tapped or while the tap is being removed.

In this embodiment, because the liner 14 is connected to the lid 116, it may be necessary initially to suspend the empty liner 14 by the neck 50 on the lid 116 such that the base of the liner 14 is spaced above the base of the outer container 12, so that the liner 14 has room to expand vertically as it is filled and pressurized.

Figure 7:
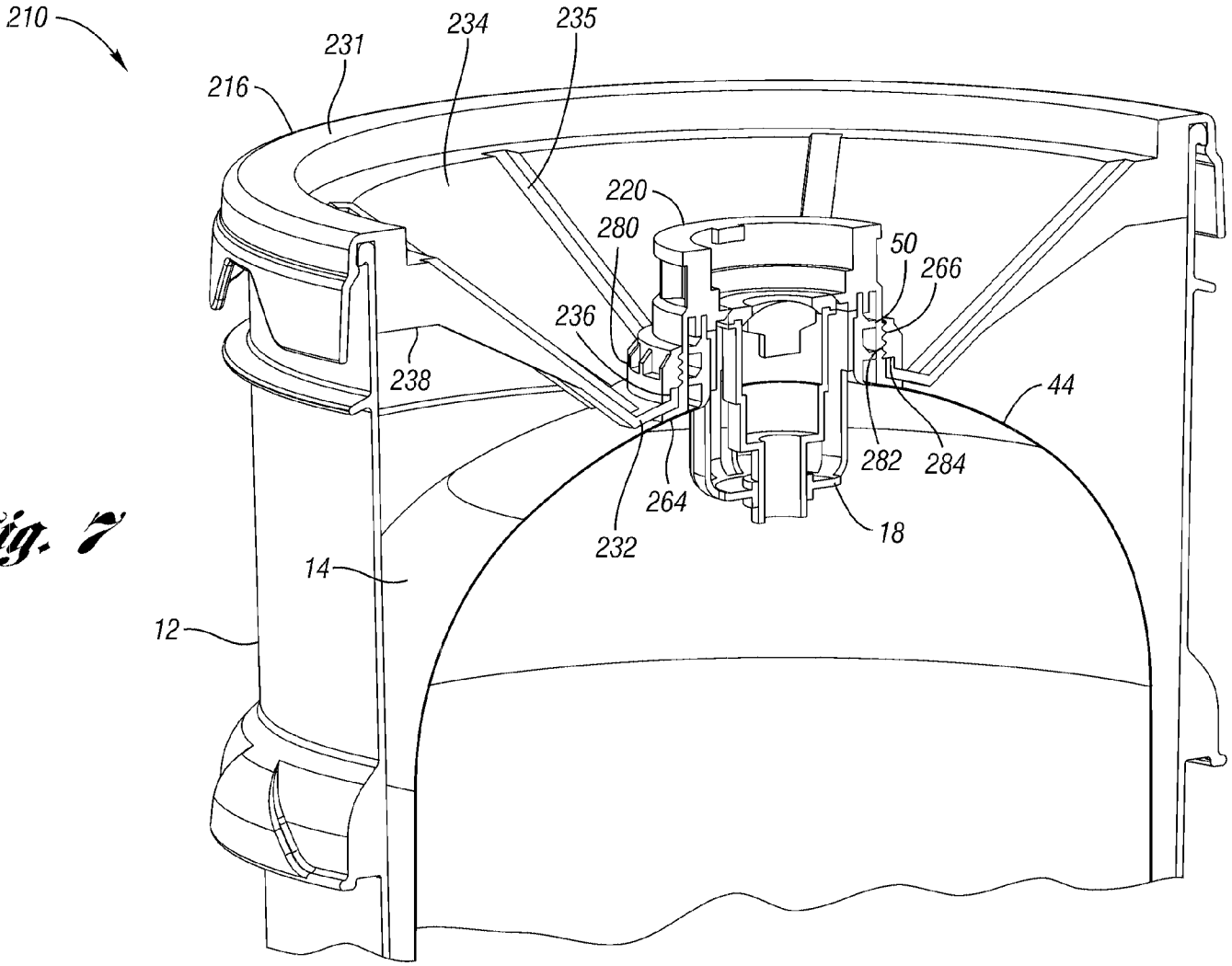
FIG. 7 is a perspective view of a plastic keg according to a third embodiment of the present invention.
Figure 8:
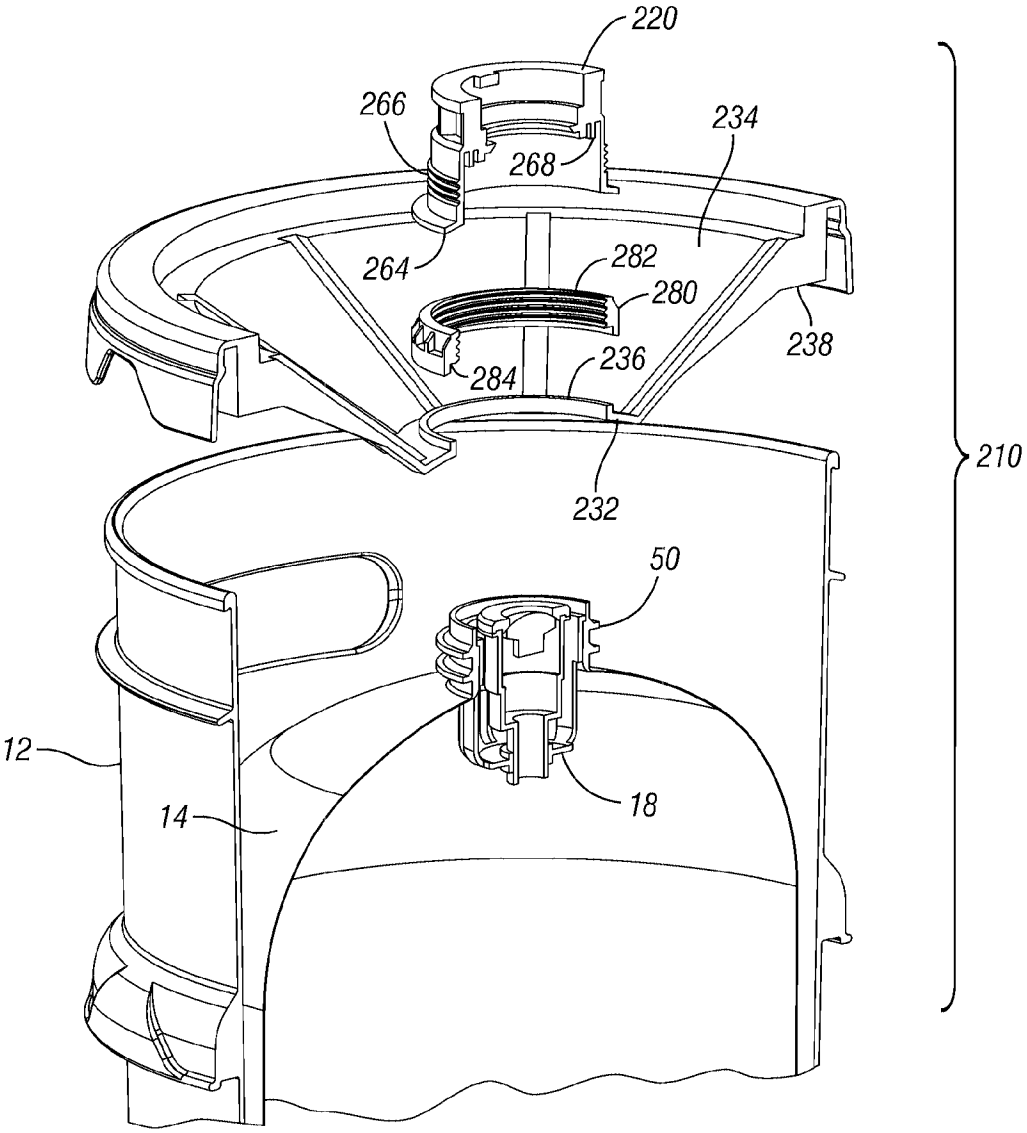
FIG. 8 is an exploded view of the keg of FIG. 7.
Figure 9:
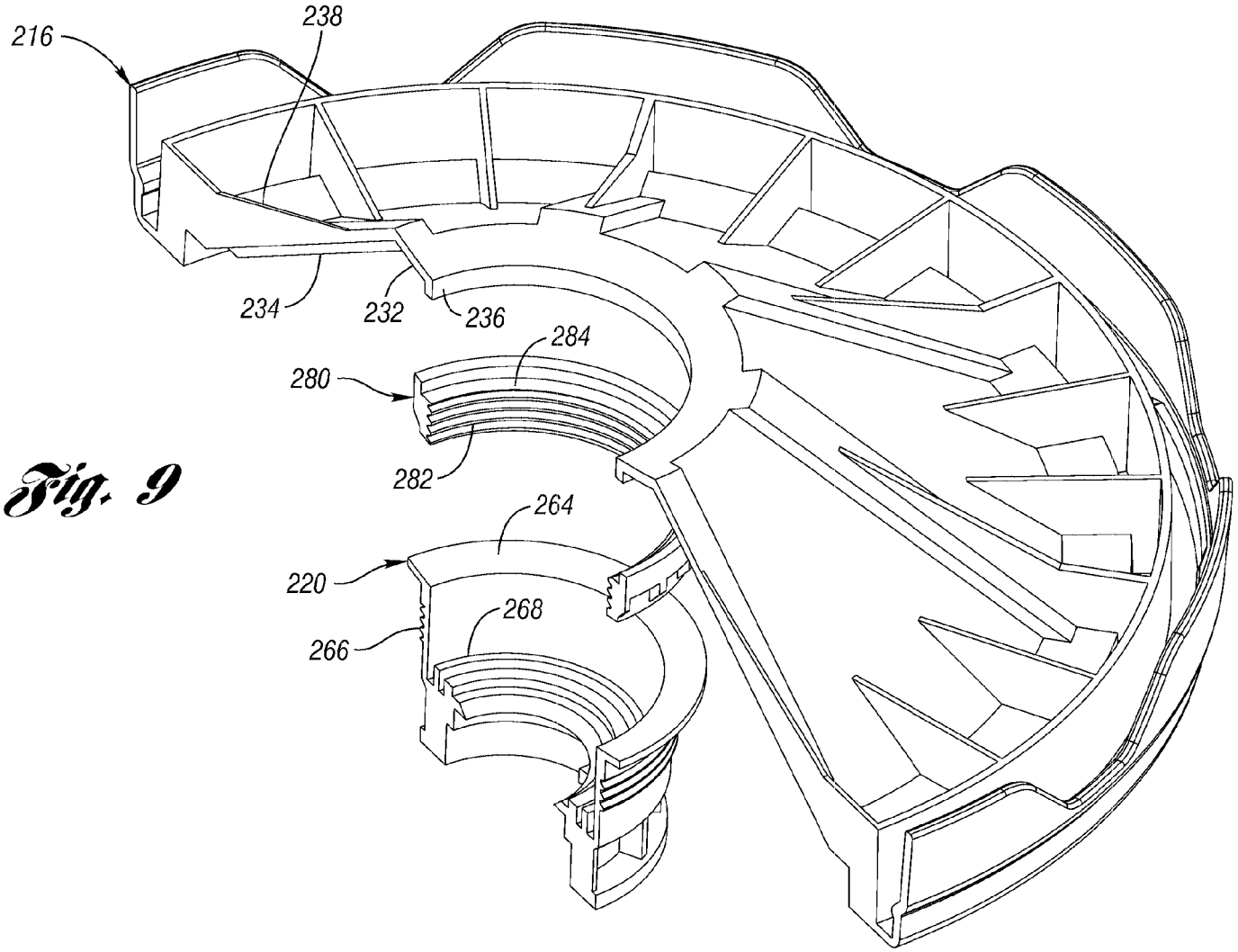
FIG. 9 is a bottom view of the exploded lid, collar and retainer of FIG. 8.

A keg 210 according to a third embodiment of the present invention is shown in FIGS. 7-9. Referring to FIG. 7, in this embodiment again, the same outer container 12 and liner 14 are used. The lid 216 in this embodiment includes a lower annular wall portion 232 having an annular rib 236 extending upwardly from the inner periphery thereof. A frustoconical portion 234 of the lid 216 extends downward from the rim portion 231 of the lid 216 to the lower annular wall portion 232 and is reinforced by ribs 238 and fluted portions 235.

The retainer 220 (head contact member) includes a generally cylindrical portion 266 threaded or otherwise connected to the neck 50 of the liner 14 and extending downward to a lower annular flange 264 bearing upon the shoulder portion 44 of the liner 14 near the neck 50.

The lid 216 further includes an annular rib 236 extending upwardly from an inner periphery of the lower annular wall portion 232.

A collar 280 includes an annular recess 284 for receiving the annular rib 236 of the lid 216. The collar 280 further includes threads 282 for threading onto the cylindrical portion 266 of the retainer 220, thereby clamping the annular rib 236 and lower annular wall portion 232 of the lid between the retainer 220 and the collar 280.

In use, in this embodiment, compressive forces on the retainer 220 are transferred by the collar 280 onto the lid 216 and then to the outer container 12, as before. However, in this embodiment, there is also the ability to remove the collar 280 from the retainer 220 after the keg 210 has been emptied during use. The lid 216 can then be removed from the outer container 12 and from the liner 14. Thus, there is no need for the user to remove the retainer 220 from the liner 14, which could still be pressurized. Optionally, the retainer 220 could therefore be secured to the neck 50 of the liner 14 in a way that is not removable by the user, while still permitting the user to remove the liner 14 and retainer 220 and valve assembly 18 for recycling, and permit the user to keep and otherwise reuse or recycle the outer container 12 and/or the lid 216.

As in the previous embodiment, because the liner 14 is connected to the lid 216, it may be necessary initially to suspend the empty liner 14 by the neck 50 on the lid 216 such that the base of the liner 14 is spaced above the base of the outer container 12, so that the liner 14 has room to expand vertically as it is filled and pressurized.

Figure 10:
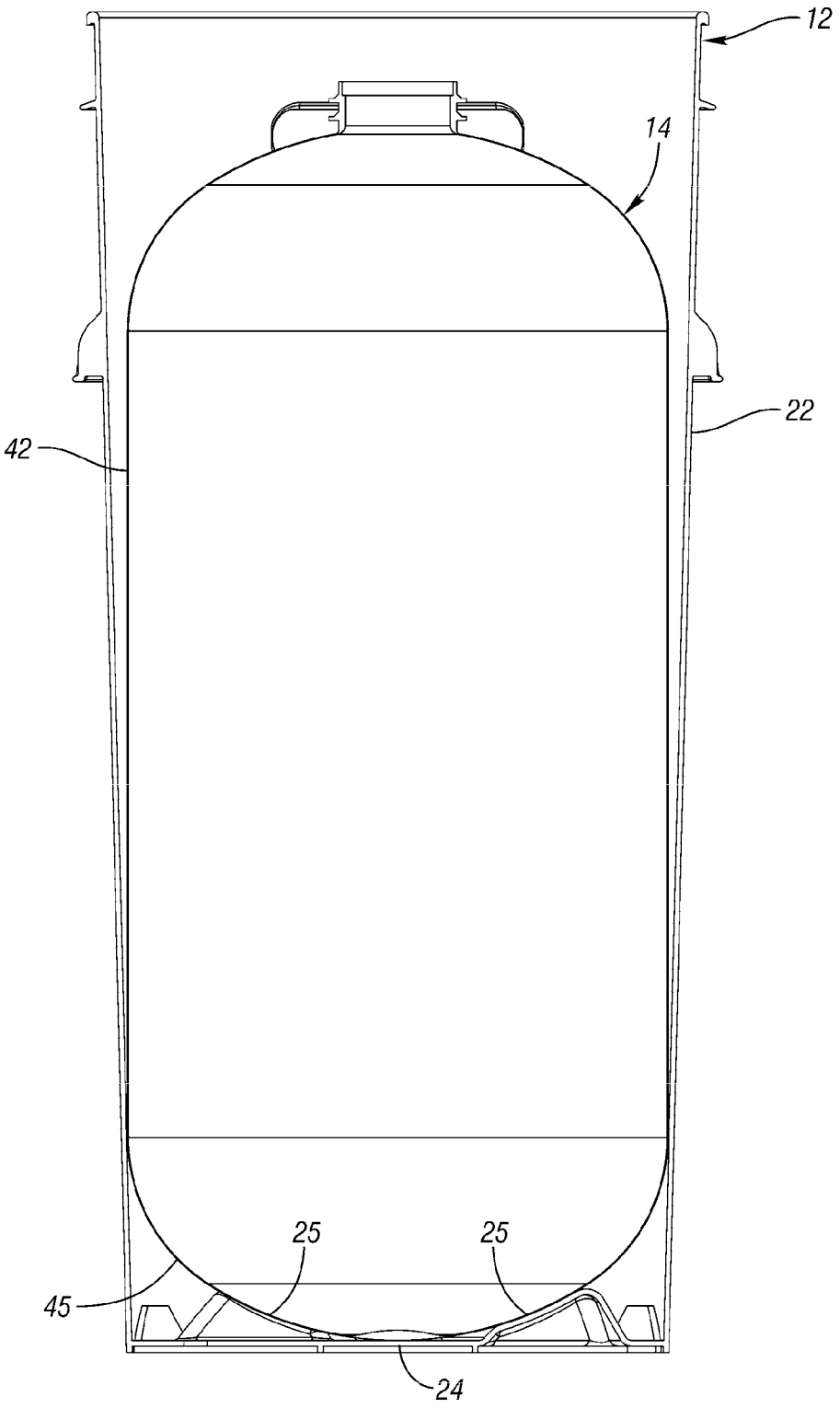
FIG. 10 is a section view of the outer container and liner of FIGS. 1, 4 and 7.

FIG. 10 is a section view of the outer container 12 and liner 14. The walls 22 of the outer container 12 extend upward from a base wall 24 which may be shaped to better support a base 45 of the liner 14. For example, the liner 14 may be generally hemispherical, which would provide increased strength and volume to the liner 14. The base 24, as shown, could include a plurality of raised portions 25 with complementary upper surfaces to provide increased surface area contact with the base 45 of the liner 14. Alternatively, the base 45 of the liner 14 could have feet or other shapes that interlock with the base 24 of the outer container 12 to prevent relative rotation between the liner 14 and outer container 12. As shown, the walls 22 of the outer container 12 may be tapered, while the walls 42 of the liner 14 are not. Alternatively, the walls 42 of the liner 14 may be tapered in a more complementary way to the walls 22 of the outer container 12.

Figure 11:
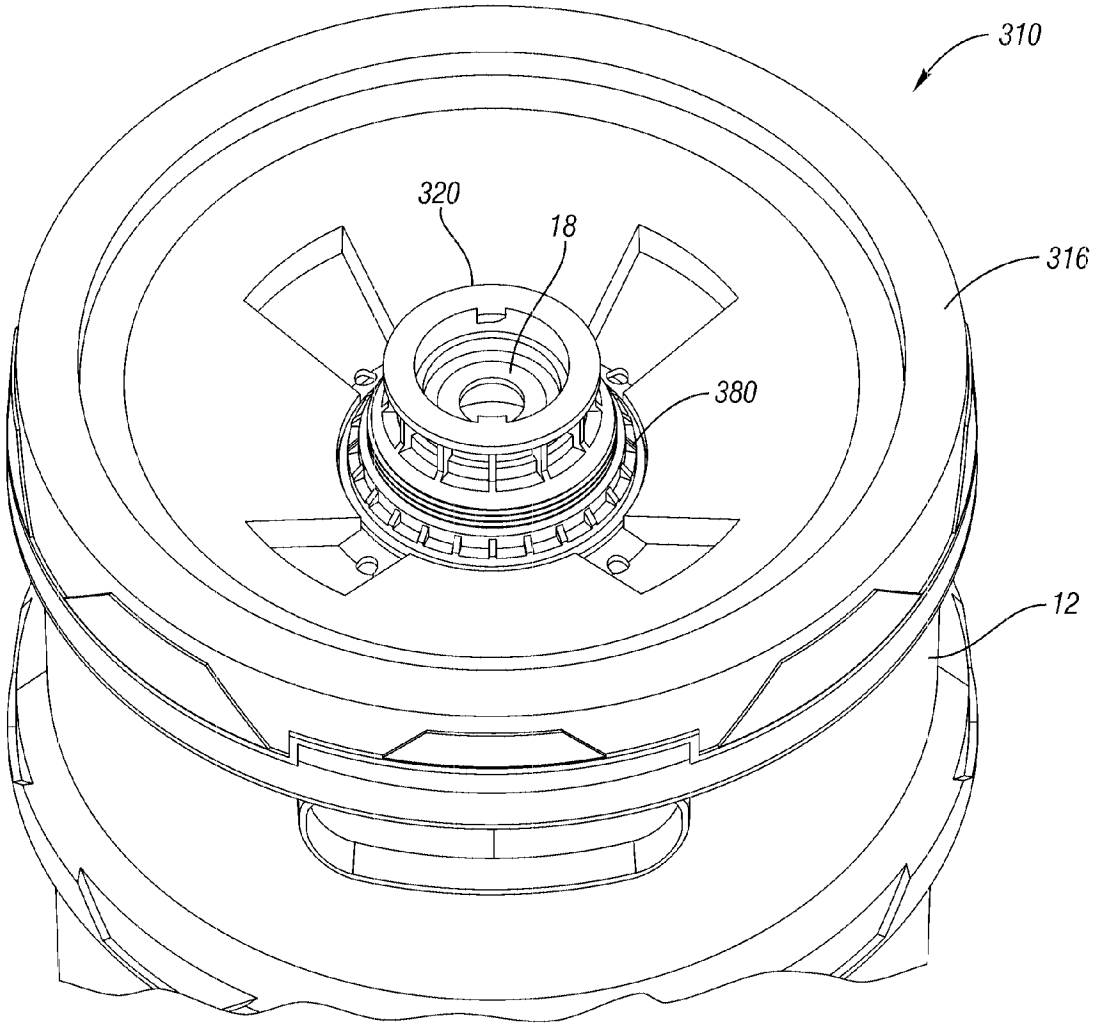
FIG. 11 is a perspective view of a plastic keg according to a fourth embodiment of the present invention.

FIG. 11 is a perspective view of a plastic keg 310 according to a fourth embodiment of the present invention. The keg 310 includes the outer container 12, liner 14 and valve assembly (FIG. 12) as before. The keg 310 includes an upper retainer 320 and collar 380 outward of a lid 316 on the outer container 12.

Figure 12:
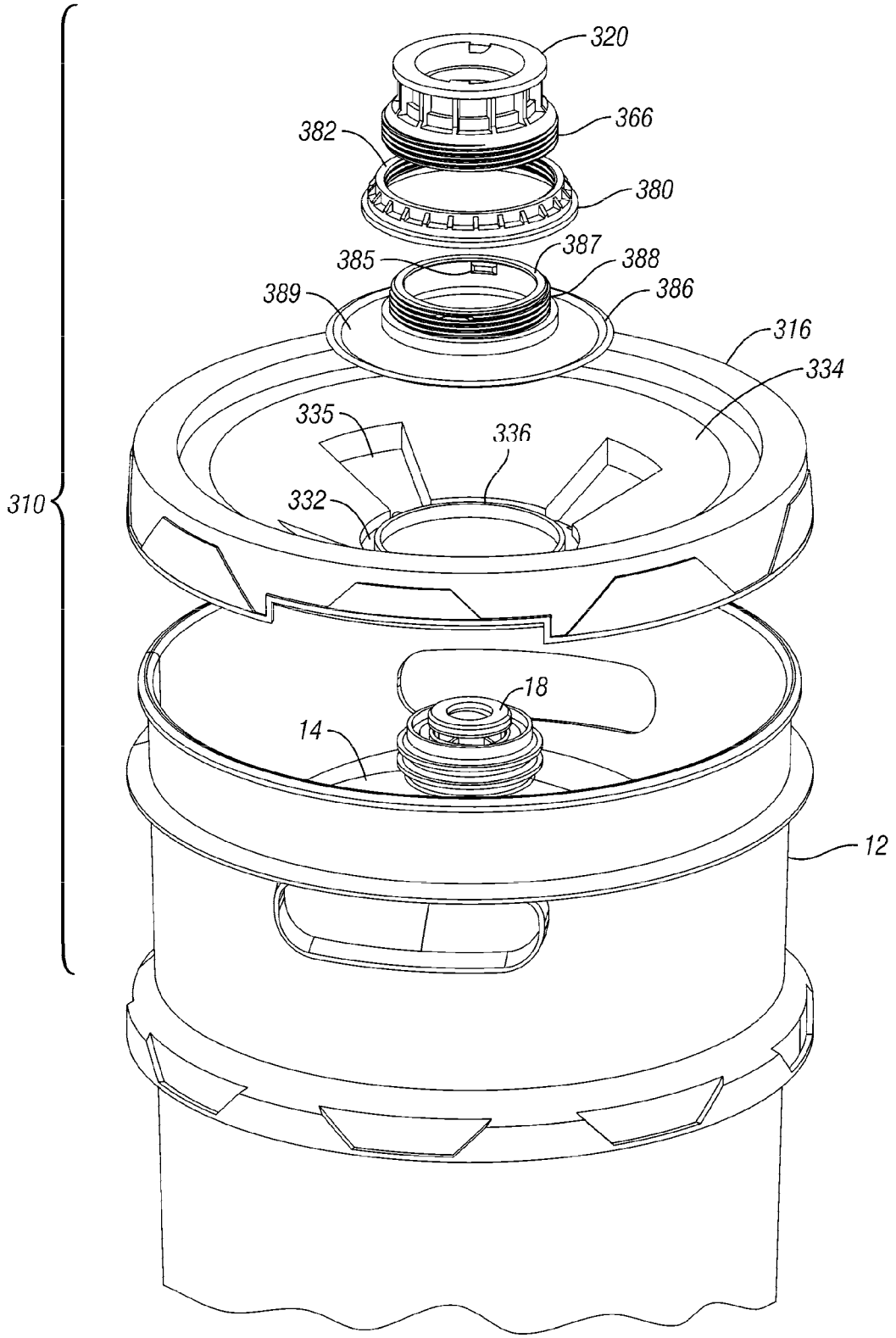
FIG. 12 is an exploded view of keg of FIG. 11.

Referring to FIG. 12, the keg 310 is similar to the keg 210 of FIGS. 7-9, but with the retainer separated into an upper retainer 320 and a lower retainer 386. The upper retainer 320 includes an externally threaded portion 366 complementary to an internally threaded surface 382 on the collar 380. The lower retainer 386 includes a cylindrical portion 387 having snap-fit tabs 385 on an interior surface and threads 388 on an exterior surface. A lower annular wall 389 extends radially from a lower edge thereof.

The lid 316 includes a lower annular wall portion 332 having an annular rib 336 extending upwardly from the inner periphery thereof. A frustoconical portion 334 of the lid 316 extends downward from the rim portion 331 of the lid 316 to the lower annular wall portion 332 and is reinforced by ribs 338 (FIG. 13) and fluted portions 335.

Figure 13:
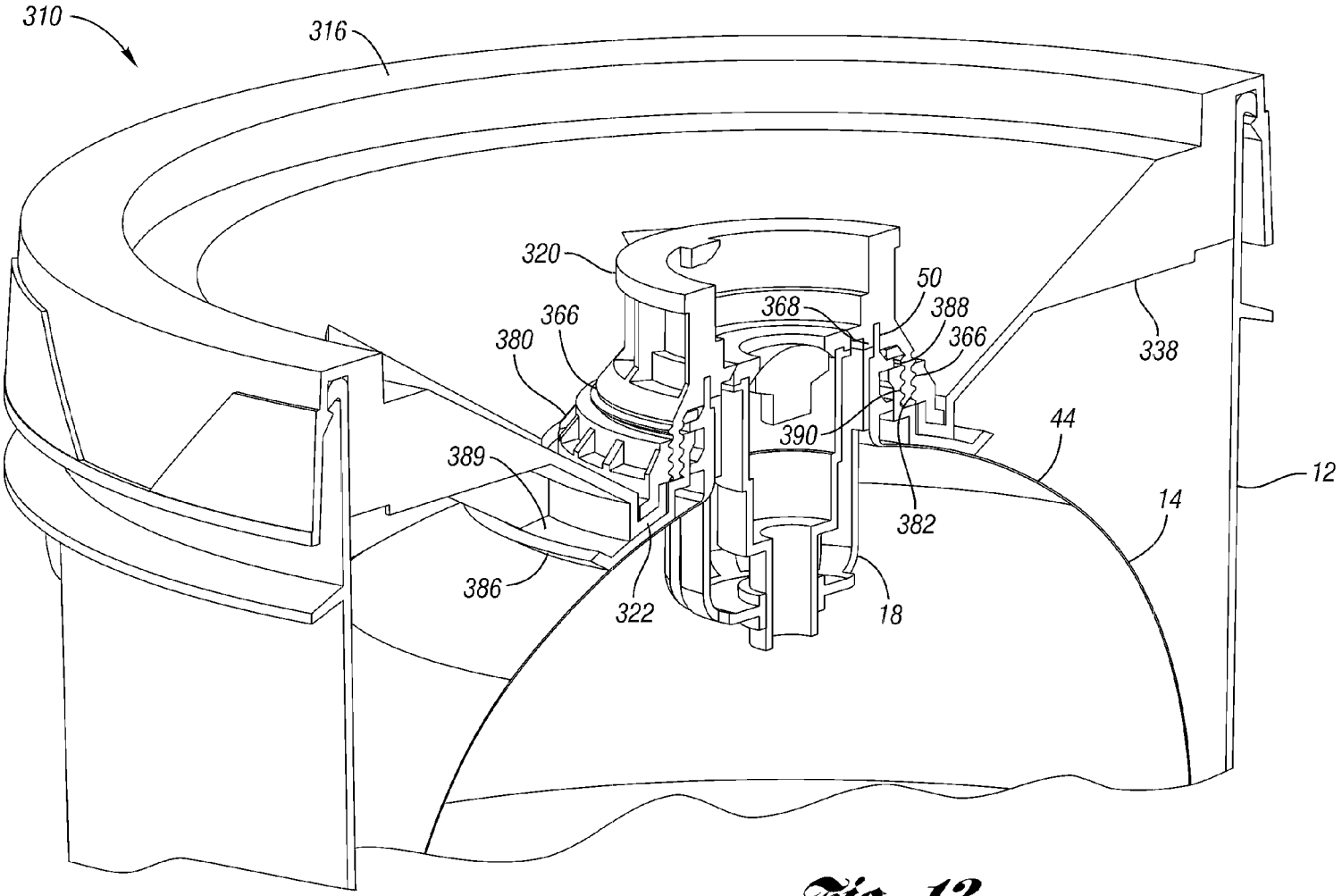
FIG. 13 is a perspective view, partially broken away, of the keg of FIG. 11.

FIG. 13 is a perspective view, partially broken away, of the keg 310 of FIG. 11. The lower retainer 386 snaps onto the neck 50 of the liner 14. The lower annular wall 389 of the lower retainer 386 contacts the shoulder portion 44 of the liner 14. Internal threads 390 on the collar portion 366 of the upper retainer 320 are screwed onto the threads 388 on the cylindrical portion 387 of the lower retainer 386. The lower annular wall portion 332 of the lid 316 rests on top of the lower annular wall 389 of the lower retainer 386. The collar 380 is threaded onto the externally threaded portion 366 of the upper retainer 320, clamping the lower annular wall portion 332 of the lid 316 between the collar 380 and the lower retainer 386. The upper retainer 320 includes an annular rib 368 that seals against the upper end of the neck 50 of the liner 14.

Figure 14:
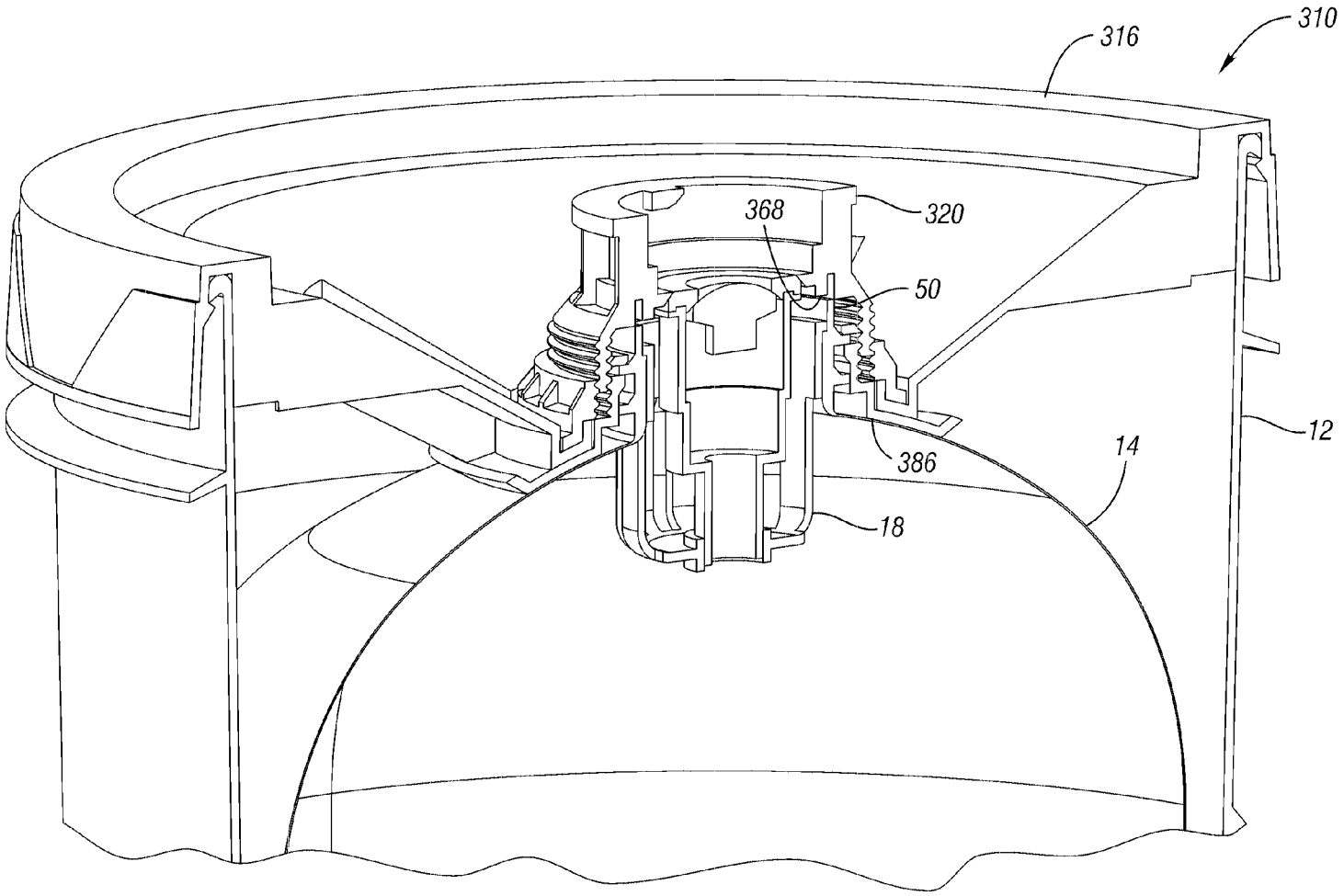
FIG. 14 shows the keg of FIG. 13 with the collar removed and the valve released.

In FIG. 14, the collar 380 (FIG. 13) is removed, and the upper retainer 320 is partially unscrewed from the lower retainer 386 until the seal between the annular rib 368 of the upper retainer 320 and the neck 50 of the liner 14 is broken. This permits pressure inside the liner 14 to be released before the upper retainer 320 is completely unscrewed.

It should also be noted that the liner 14, valve assembly 18, lower retainer 386 and upper retainer 320 can all be shipped as a sealed unit for installation into the outer container 12 and lid 316 without unsealing the unit.

Figure 15:
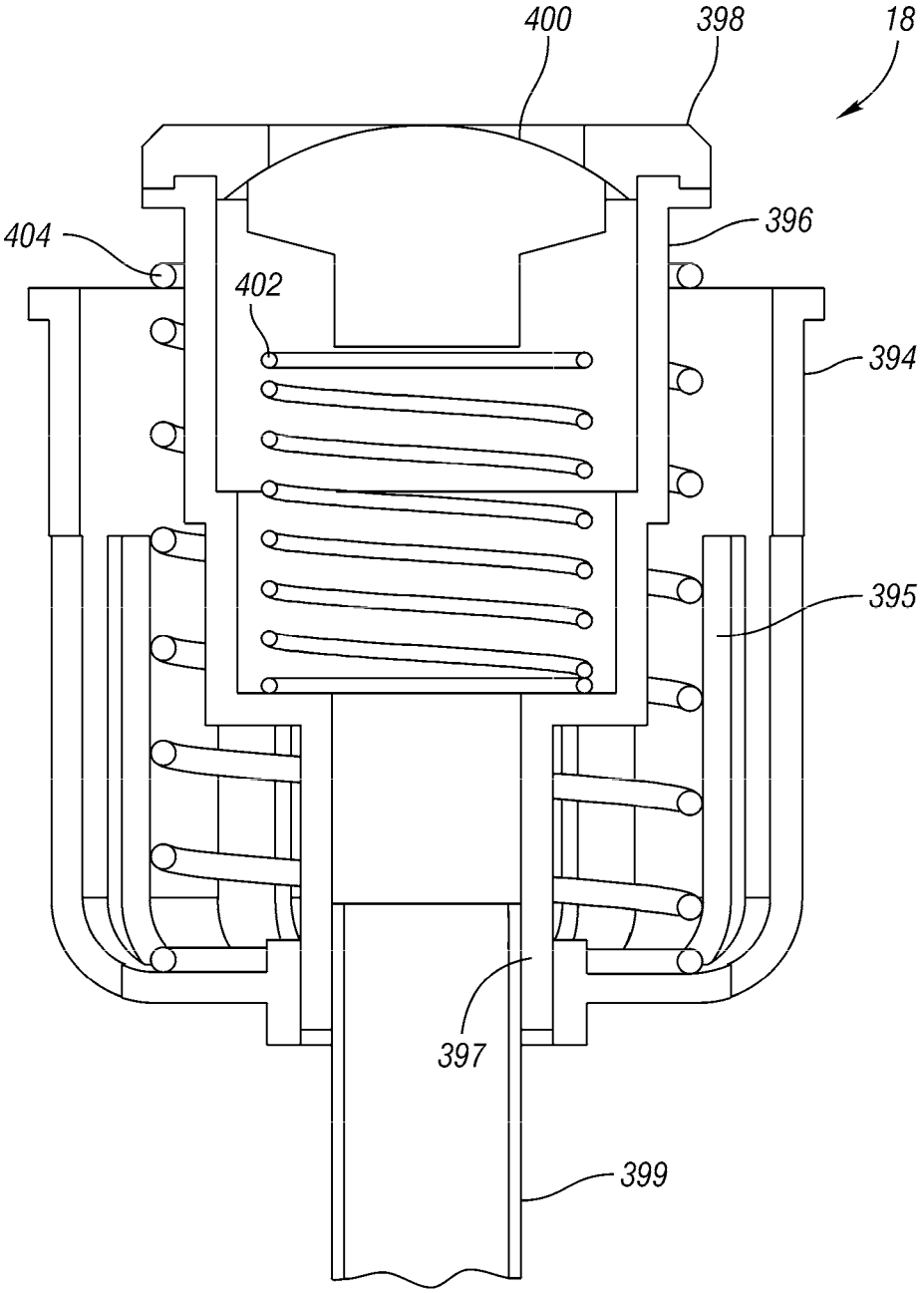
FIG. 15 is a section view of an example valve assembly that could be used in the kegs of FIGS. 1-14.

FIG. 15 shows a valve assembly 18 that could be used in the kegs 20, 120, 220, 320. The valve assembly 18 includes an outer cup 394 having slots 395 therethrough that are high enough to permit complete draining of the liner 14 when inverted. A piston 396 is received within the outer cup 394 and includes an annular cap 398 mounted at an outer end. A lower cylindrical end 397 of the piston 396 connects to a semi-flexible tube 399 which reaches to the base of the liner 14. The annular cap 398 retains a port 400 against an inner spring 402. An outer spring 404 biases the piston 396 away from the outer cup 394.

Although the outer container 12 is shown as cylindrical, it is contemplated that other shapes, such as square or rectangular cross-sections, of containers may also be utilized.

In all of the embodiments, the retainer 20, 120, 220, 320 may include a tab or button which must be pressed before the retainer can be unscrewed from the neck 50 of the liner 14. Optionally, with a ¼ turn of the retainer (or so), the liner 14 can be depressurized. Then, the retainer can be completely unscrewed, possibly by first completely breaking snaps or tabs. This forces a user to release the pressure in the liner 14 before completely releasing the retainer and valve assembly 18. In the second embodiment, the user is prevented from removing a pressurized liner 14 from the outer container 12 because the retainer 120 must be removed first. As another option, it may be desirable to design the retainers 20, 120, 220, 320 to break (such as along weakened portions) as they are being removed, to prevent them from being reused.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. For example, although some of the inventive features described herein provide the ability to fill the keg in an inverted orientation in existing filling equipment with high clamping forces, it is also anticipated that the kegs would be desirable for use with upright filling, both automated and manually.

What is claimed is:

1. A plastic beer keg including:

a container having a base and a wall extending upward from a periphery of the base to define a container interior, the wall molded integrally with the base;

a plastic liner within the container interior, the liner including a neck portion, a body portion and a shoulder portion between the neck portion and the body portion, wherein the neck portion, the body portion and the shoulder portion are integrally molded as a single piece of plastic;

a valve assembly connected within the neck portion of the liner, the valve assembly including a spring biasing a port member toward an opening to close the opening; and a retainer adjacent the valve assembly for transferring axial load away from the neck portion of the liner, the retainer secured to an outer surface of the neck portion of the liner, the retainer securing the valve assembly to the neck portion of the liner.

2. The plastic beer keg of claim 1 further including a lid secured to an upper peripheral portion of the wall of the container over at least a portion of the liner.

3. The plastic beer keg of claim 2 wherein the retainer transfers axial load applied to the retainer to the lid instead of to the neck portion of the liner.

4. The plastic beer keg of claim 3 wherein the lid includes a lower wall portion adjacent a shoulder portion of the liner radially outward of the neck portion.

5. The plastic beer keg of claim 4 wherein the lower wall portion of the lid is offset downwardly from an upper peripheral portion of the lid, such that the retainer is recessed relative to the upper peripheral portion of the lid.

6. The plastic beer keg of claim 1 wherein the retainer includes an upper retainer portion and a lower retainer portion, upper retainer portion removably connected to the lower retainer portion.

7. The plastic beer keg of claim 6 wherein the lower retainer portion contacts a shoulder portion of the liner between the neck portion and the body portion.

8. The plastic beer keg of claim 7 wherein the upper retainer portion is threaded to the lower retainer portion.

9. The plastic beer keg of claim 8 further including a collar portion connecting the upper retainer portion to a lid on the container.

10. The plastic beer keg of claim 1 wherein the retainer includes a skirt extending radially from the neck of the liner onto a shoulder portion of the liner.

11. The plastic beer keg of claim 1 wherein the plastic liner is a PET bottle, the PET bottle including the neck portion, the body portion and the shoulder portion.

12. The plastic beer keg of claim 11 wherein the valve assembly abuts an interior surface of the neck portion of the bottle.

13. The plastic beer keg of claim 12 wherein the neck portion is within the retainer.

14. A plastic beer keg including:

a container having a base and a wall extending upward from a periphery of the base to define a container interior, the wall molded integrally with the base;

a PET bottle within the container interior, the bottle including a neck portion, a body portion and a shoulder portion between the neck portion and the body portion, wherein the neck portion, the body portion and the shoulder portion are integrally molded as a single piece of plastic;

a lid secured to the wall of the container over at least a portion of the bottle, the lid including a lower wall portion adjacent a shoulder portion of the bottle radially outward of the neck portion, the lower wall portion of the lid offset downwardly from an upper peripheral portion of the lid;

a valve assembly connected within the neck portion of the bottle, the valve assembly abuting an interior surface of the neck portion of the bottle, the valve assembly including a spring biasing a port member toward an opening to close the opening; and a retainer that secures the valve assembly to the neck portion of the PET bottle, the retainer secured to the neck portion of the bottle, the retainer adjacent the valve assembly for transferring axial load away from the neck portion of the PET bottle, the retainer transferring axial load applied to the retainer to the lid instead of to the neck portion of the bottle.

15. The plastic beer keg of claim 14 wherein the retainer includes an upper retainer portion and a lower retainer portion, upper retainer portion removably connected to the lower retainer portion.

16. The plastic beer keg of claim 15 wherein the upper retainer portion is threaded to the lower retainer portion.

17. The plastic beer keg of claim 16 further including a collar portion connecting the upper retainer portion to a lid on the container.

18. A plastic beer keg including:

a container having a base and a wall extending upward from a periphery of the base to define a container interior, the wall molded integrally with the base;

a plastic liner within the container interior, the liner including a neck portion, a body portion and a shoulder portion between the neck portion and the body portion, wherein the neck portion, the body portion and the shoulder portion are integrally molded as a single piece of plastic;

a valve assembly within the neck portion of the liner, the valve assembly including a spring biasing a port member toward an opening to close the opening and thereby close the neck portion;

a retainer secured to an outer surface of the neck portion to retain the valve assembly within the neck portion;

a lid secured to the wall of the container over at least a portion of the liner, the lid including a lid opening receiving the neck portion; and a collar secured to an outer surface of the retainer, the collar securing the lid between the collar and the shoulder portion of the plastic liner.

19. The plastic beer keg of claim 18 wherein the plastic liner is a PET bottle.

* * * * *